US010779595B1

(12) United States Patent
Hurst

(10) Patent No.: US 10,779,595 B1
(45) Date of Patent: Sep. 22, 2020

(54) HAIR EXTENSION ATTACHMENT DEVICE

(71) Applicant: Ramada L. Hurst, Omaha, NE (US)

(72) Inventor: Ramada L. Hurst, Omaha, NE (US)

( * ) Notice: Subject to any disclaimer, the term of this patent is extended or adjusted under 35 U.S.C. 154(b) by 173 days.

(21) Appl. No.: 14/996,640

(22) Filed: Jan. 15, 2016

Related U.S. Application Data

(60) Provisional application No. 62/103,763, filed on Jan. 15, 2015.

(51) Int. Cl.
*A41G 5/00* (2006.01)

(52) U.S. Cl.
CPC ..... *A41G 5/0086* (2013.01)

(58) Field of Classification Search
CPC ..... A41G 5/0086; A45D 2002/005; A45D 2002/007; A45D 2002/008; D05B 55/06; D05B 55/08; D05B 83/00; D05B 73/005
USPC ..... 132/201; 112/169, 227, 261
See application file for complete search history.

(56) References Cited

U.S. PATENT DOCUMENTS 2,594,534 A * 4/1952 Bell ..... D05B 81/00 112/169
2,604,861 A * 7/1952 Merson ..... D05B 81/00 112/169
2,639,683 A * 5/1953 Huntington ..... D05B 81/00 112/169
2,945,460 A * 7/1960 Kagiyama ..... D05B 13/00 112/169
3,745,950 A * 7/1973 Kato ..... D05B 73/00 112/169
4,505,213 A * 3/1985 Killinger ..... D05B 27/04 112/169
5,669,318 A * 9/1997 Tsay ..... D05B 1/12 112/169
9,271,535 B1 * 3/2016 Townsend ..... A41G 5/0086
2009/0056733 A1 * 3/2009 White ..... A41G 5/0053 132/201

OTHER PUBLICATIONS http://www.singerco.com/accessories/detail/2381/stitch-sew-quick.

* cited by examiner

*Primary Examiner* — Rachel R Steitz
*Assistant Examiner* — Brianne E Kalach
(74) *Attorney, Agent, or Firm* — Kevin E. West; Advent, LLP

(57) ABSTRACT

A hair extension attachment device comprises a housing that includes a sewing mechanism, and a guard configured to shield the sewing mechanism from an individual. The sewing mechanism is configured to receive a first hair section from the individual (e.g., a braid) and a second hair section (e.g., a hair extension or weft) not from the individual, and sew the first and second hair sections together, affixing the second hair section to the individual.

8 Claims, 2 Drawing Sheets

HAIR EXTENSION ATTACHMENT DEVICE

CROSS-REFERENCE TO RELATED APPLICATIONS

The present application claims the benefit under 35 U.S.C. § 119(e) of U.S. Provisional Application Ser. No. 62/103,763, filed Jan. 15, 2015, and titled "HAIR EXTENSION ATTACHMENT DEVICE," which is herein incorporated by reference in its entirety.

BACKGROUND

Hair extensions are used to lengthen hair, generally by incorporating artificial hair and/or natural hair collected from one or more other individuals. Temporary hair extensions can be referred to as "wefts."

SUMMARY

A hair extension attachment device comprises a housing that includes a sewing mechanism, and a guard configured to shield the sewing mechanism from an individual. The sewing mechanism is configured to receive a first hair section from the individual (e.g., a braid) and a second hair section (e.g., a hair extension or weft) not from the individual, and sew the first and second hair sections together, affixing the second hair section to the individual. The guard can be removably attached to the housing, e.g., configured as an attachment that can be affixed to the housing. The guard can also be integrally formed with the housing.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Figure 1:
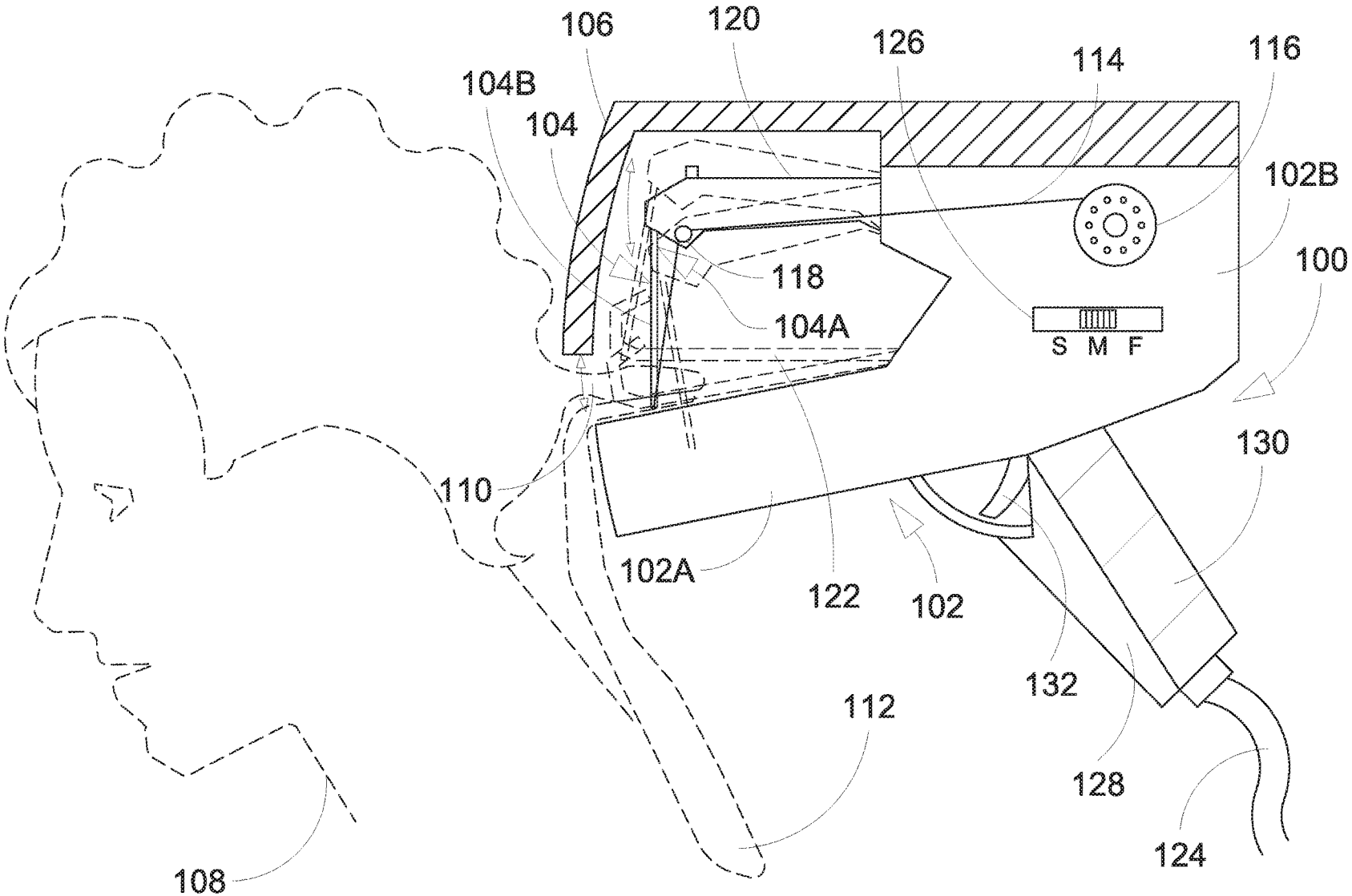
FIG. 1 is a partial cross-sectional side elevation view illustrating a handheld hair extension attachment device in accordance with example embodiments of the present disclosure.
Figure 2:
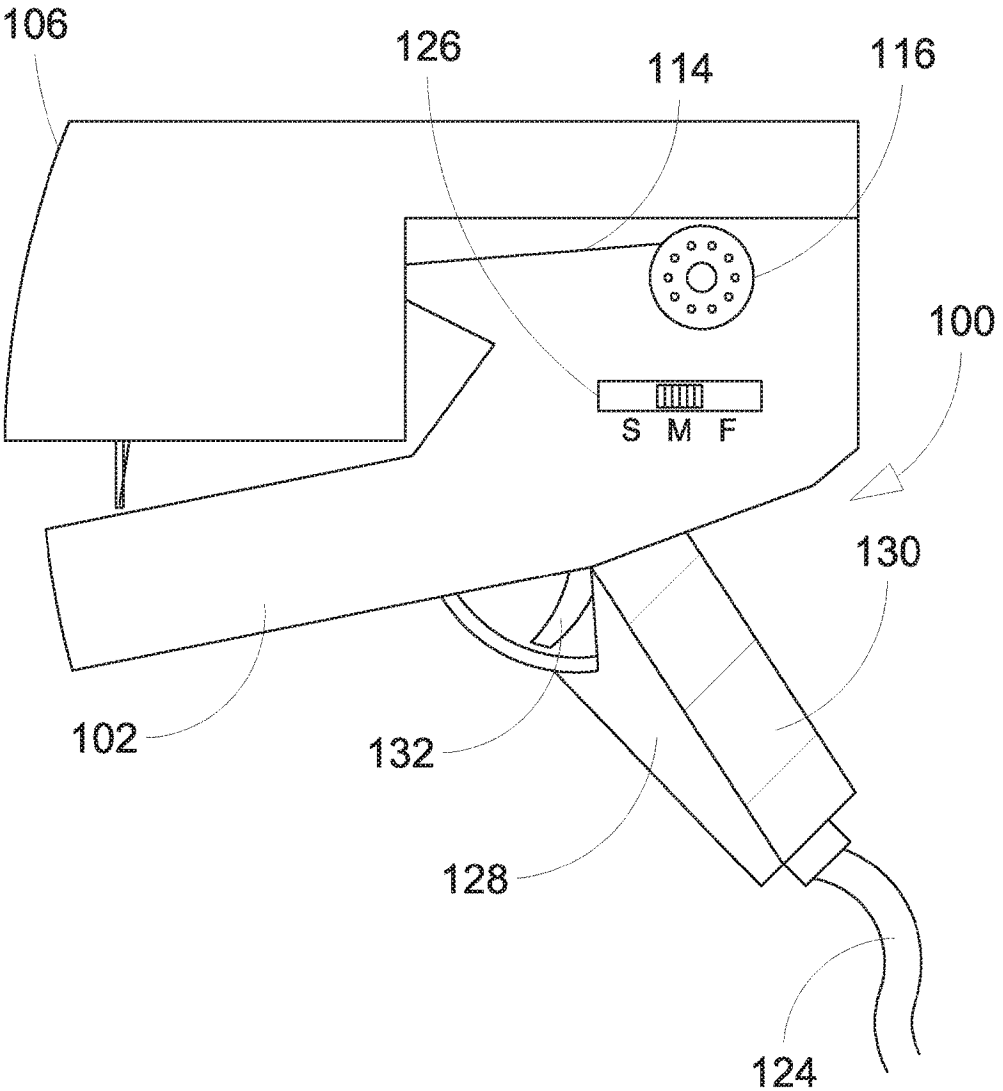
FIG. 2 is a partial side elevation view of a handheld hair extension attachment device, such as the handheld hair extension attachment device illustrated in FIG. 1, in accordance with an example embodiment of the present disclosure.

Referring generally to FIGS. 1 and 2, a handheld hair extension attachment device 100 is described in accordance with example embodiments of the present disclosure. The hair extension attachment device 100 comprises a housing 102 that includes a forward housing portion 102A and a rear housing portion 102B (i.e., where the forward housing portion 102A lies laterally ahead of the rear housing portion 102B), where the rear housing portion 102B carries a sewing mechanism (e.g., including a needle 104 and an arm 120) with the sewing mechanism extending over the forward housing portion 102A. The needle 104 can include a mounted needle portion 104A and a free needle portion 104B. The mounted needle portion 104A can be attached to the arm 120, and the free needle portion 104B can extend away and downwardly from the arm 120 and generally toward the forward housing portion 102A (e.g., possibly partially extending into the forward housing portion 102B during a part of the downstroke of the needle 102). The hair extension attachment device 100 also includes a guard 106. The guard 106 is carried on the rear housing portion 102B and is configured, as readily seen in FIG. 1, to extend both above the sewing mechanism and the forward housing portion 102A and vertically in front of at least a section (e.g., a majority section) of the free needle portion 104B of the sewing needle 104 of the sewing mechanism and thereby shield the sewing mechanism and, particularly, the needle 104 thereof from a head of an individual 108. The guard 106 is able to shield the sewing mechanism from the head of the individual 108 because the guard 106 establishes an outer perimeter portion of the hair extension attachment device 100 proximate the sewing mechanism, including the needle 104. The guard 106, the rear housing portion 102B, and the forward housing portion 102A together can thereby define an interior travel volume through which the sewing mechanism (e.g., the needle 104 and the arm 120) can move, as illustrated by the variable positioning of the sewing mechanism within FIG. 1.

In embodiments of the disclosure, the sewing mechanism is configured to receive a first hair section 110 from the individual 108 and a second hair section 112 not from the individual 108 through a gap defined between the guard 106 and the forward portion of the housing 102, and sew the first and second hair sections 110 and 112 together, affixing the second hair section 112 to the individual 108. For example, the first hair section 110 comprises a braid, such as a cornrow braid, and the second hair section 112 comprises one or more hair extensions, such as a weft, used to form, for example, a weave. In some embodiments, the guard 106 is removably attached to the housing 102 that includes the sewing mechanism. For example, the guard 106 is configured as an attachment that can be affixed to the housing 102 (e.g., to the rear housing portion 102B) of a handheld sewing mechanism. In other embodiments, the guard 106 is integrally formed with the housing 102.

In embodiments of the disclosure, the hair extension attachment device 100 includes a needle 104 that can be straight or curved. In some embodiments, the needle 104 is a blunt-ended needle. Further, in some embodiments, the needle 104 may be formed from a plastic material (e.g., surgical plastic). The needle 104 receives thread 114 (e.g., from a bobbin 116), which can be routed through a thread feeder 118 and then through the needle 104. The needle 104 can be supported by the arm 120, which can travel alternately in generally upward and downward directions to repeatedly insert the needle 104 through the first and second hair sections 110 and 112. The arm 120 can be carried by the rear housing portion 102B and can then extend over the forward housing portion 102A, as seen in FIG. 1 (i.e., the arm 120 being located vertically above the forward housing portion 102A). The hair extension attachment device 100 can also include a plate 122, which can be used to press against the hair and hold it in position with respect to the needle 104. In some embodiments, the sewing mechanism can employ a chainstitch, e.g., where a single thread is used to sew the first and second hair sections 110 and 112. However, this example is not meant to the limit the present disclosure. In other embodiments, the sewing mechanism can use various other mechanical sewing techniques, including, but not necessarily limited to: lockstitching, overlocking, coverstitching, zigzag stitching, and so forth. For example, in another embodiment, the sewing mechanism employs a lockstitching technique and uses two separate threads.

In some embodiments, the hair extension attachment device 100 can be hand powered. For example, an operator repeatedly presses down on the arm 120 to sew the first and second hair sections 110 and 112 together. In other embodiments, the hair extension attachment device 100 can be mechanically and/or electrically powered. For example, the hair extension attachment device 100 can include an electric motor powered by electrical energy delivered from an electrical outlet (e.g., AC mains). A power cord 124 can be included to connect the hair extension attachment device 100 to an electrical outlet. However, a power cord 124 is provided by way of example and is not meant to limit the present disclosure. In other embodiments, the hair extension attachment device 100 can be battery powered (e.g., using disposable and/or rechargeable batteries), various combinations of electrically and battery powered, and so forth. Further, in some embodiments, the hair extension attachment device 100 can include a speed control 126 for controlling the speed of the sewing mechanism. The hair extension attachment device 100 can also include a handle 128, which can include, for instance, a grip 130 (e.g., a soft rubber grip), and a trigger 132 for actuating the sewing mechanism.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A hair extension attachment device comprising:

a housing configured to receive a first hair section from a head of an individual and a second hair section not from the individual, the housing including a forward housing portion and a rear housing portion, the forward housing portion being laterally ahead of the rear housing portion, the housing defining a top housing surface and a bottom housing surface opposite the top housing surface;

a sewing mechanism carried by the rear housing portion and extending over the forward housing portion, the sewing mechanism comprising an arm and a needle, the arm carried by the rear housing portion and positioned above the forward housing portion, the arm configured to travel alternatively in generally upward and generally downward directions and thereby away from and toward the forward housing portion, the needle including a mounted needle portion and a free needle portion, the mounted needle portion carried by the arm, the free needle portion extending away from the arm;

a speed control for controlling a speed of the sewing mechanism;

a guard carried on a portion of the top housing surface associated with the rear housing portion, the guard extending horizontally both above the sewing mechanism and the forward housing portion and then vertically in front of at least a section of the free needle portion of the needle of the sewing mechanism, the guard defining an outer perimeter portion of the hair extension attachment device proximate the sewing mechanism and above the forward housing portion, the guard thereby configured to shield the sewing mechanism and the needle thereof from the head of the individual, the guard and the forward housing portion together defining a gap through which the first hair section from the individual can be received to facilitate sewing thereof with the second hair section not from the individual, the guard, the rear housing portion, and the forward housing portion together defining an interior travel volume through which the sewing mechanism is configured to travel; and a handle provided with a trigger for actuating the sewing mechanism, the handle extending from the bottom housing surface.

2. The hair extension attachment device as recited in claim 1, wherein the housing is configured to receive the first hair section, the first hair section comprising a braid.

3. The hair extension attachment device as recited in claim 1, wherein the guard is removably attached to the housing.

4. The hair extension attachment device as recited in claim 1, wherein the guard is integrally formed with the housing.

5. A hair extension attachment device comprising:

a housing configured to receive a first hair section from a head of an individual and a second hair section not from the individual, the housing including a forward housing portion and a rear housing portion, the forward housing portion being laterally ahead of the rear housing portion, the housing defining a top housing surface and a bottom housing surface opposite the top housing surface;

a sewing mechanism carried by the rear housing portion and extending over the forward housing portion, the sewing mechanism comprising an arm and a needle, the arm carried by the rear housing portion and positioned above the forward housing portion, the arm configured to travel alternatively in generally upward and generally downward directions and thereby away from and toward the forward housing portion, the needle including a mounted needle portion and a free needle portion, the mounted needle portion carried by the arm, the free needle portion extending away from the arm;

a guard carried by a portion of the top housing surface associated with the rear housing portion, the guard extending horizontally both above the sewing mechanism and the forward housing portion and then vertically in front of at least a section of the free needle portion of the needle of the sewing mechanism, the guard establishing an outer perimeter portion of the hair extension attachment device proximate the sewing mechanism, the guard thereby configured to shield the sewing mechanism from the head of the individual, the guard and the forward housing portion together defining a gap through which the first hair section from the individual can be received to facilitate sewing thereof with the second hair section not from the individual, the guard, the rear housing portion, and the forward housing portion together defining an interior travel volume through which the sewing mechanism is configured to travel; and a handle provided with a trigger for actuating the sewing mechanism, the handle extending from the bottom housing surface.

6. The hair extension attachment device as recited in claim 5, wherein the housing is configured to receive the first hair section, the first hair section comprising a braid.

7. The hair extension attachment device as recited in claim 5, wherein the guard is removably attached to the housing.

8. The hair extension attachment device as recited in claim 5, wherein the guard is integrally formed with the housing.

* * * * *